United States Patent [19]

Wagu et al.

[11] 4,285,797

[45] Aug. 25, 1981

[54] CATHODE FOR THE ELECTROLYTIC TREATMENT OF ALKALI HALIDE

[75] Inventors: Masakatsu Wagu; Makoto Fukuda; Shirou Suzuki, all of Iwaki, Japan

[73] Assignee: Kureha Kagaku Kogyo Kabushiki Kaisha, Tokyo, Japan

[21] Appl. No.: 41,783

[22] Filed: May 23, 1979

[30] Foreign Application Priority Data

May 24, 1978 [JP] Japan ..... 53/61044

[51] Int. Cl.[3] ..... C25B 11/08

[52] U.S. Cl. ..... 204/290 R; 204/47

[58] Field of Search ..... 204/47, 290 R

[56] References Cited

U.S. PATENT DOCUMENTS

| | | | |
|---|---|---|---|
| 3,103,473 | 9/1963 | Juda | 204/77 |
| 3,250,646 | 5/1966 | Hipp | 429/45 |
| 3,515,651 | 6/1970 | Ohkubo et al. | 204/43 |
| 3,528,895 | 9/1970 | Simionian | 204/44 |
| 4,097,347 | 6/1978 | Packer | 204/109 |
| 4,157,943 | 6/1979 | Scarpellino et al. | 204/37 R |

*Primary Examiner*—F. Edmundson

*Attorney, Agent, or Firm*—Fleit & Jacobson

[57] ABSTRACT

The invention relates to cathodic electrodes for use in the electrolytic treatment of alkali halide. The electrode has a substantial mass of copper or copper alloy, and the surface of the mass is roughened and activated by blasting solid and abrasive particles against the mass surface. The roughened surface is then coated with a rhodium or rhodium alloy layer. The effect is a substantial reduction of hydrogen superpotential value.

1 Claim, 2 Drawing Figures

CATHODE FOR THE ELECTROLYTIC TREATMENT OF ALKALI HALIDE

BACKGROUND OF THE INVENTION

The invention relates to improvements in and relating to cathodes for use in the electrolysis of an aqua-solution of alkali halide.

In the process for the electrolysis of an aqua-solution of alkali halide such as NaCl or KCl to obtain the corresponding caustic alkali and chlorine, the aqua-solution is supplied naturally to an electrolytic vessel provided therein with at least an anode and at least a cathode. When electrolytic voltage is applied between the cathode and the anode, the caustic alkali will develop in the electrolyte contacting with the cathode, while gaseous chlorine and gaseous hydrogen develop at the anode and the cathode, respectively, when expressed in a generalized conception.

In the diaphragm electrolysis, DSA-electrodes are commonly used as the anodes, while steel is generally used as the material of the cathodes, according to the presently employed technique.

When expressing generally the whole progress of the electrolysis, the anodic reaction progresses in the following sense:

$$2Cl^- \rightarrow Cl_2 + 2e^- \quad \text{(a)}$$

and the cathodic reaction progresses in the following sense:

$$2H_2O + 2e^- \rightarrow H_2 + 2OH^- \quad \text{(b)}$$

More precisely, the cathodic reaction is called to take place in the following way:

$$H_2O + e^- \rightarrow H\ (\text{adsorption}) + OH^- \quad \text{(c)}$$

In this way, monoatomic hydrogen is adsorbed on the cathodic electrode surface. In the alkaline medium, the once adsorbed hydrogen is desorbed in the following one step or two step process:

$$2H\ (\text{adsorption}) + H_2O \rightarrow H_2;\ \text{or} \quad \text{(d)}$$

$$H\ (\text{adsorption}) + H_2O + e^- \rightarrow H_2 + OH^- \quad \text{(e)}$$

The above hydrogen desorbing stage (d) or (e) is said to be decisive of the hydrogen overpotential.

On the other hand, the hydrogen-generating potential in the above state (b) will amount to about 1.5–1.6 volts with soft steel electrode relative to saturated calomel electrode (SCE) and in the alkaline medium.

Various and profound efforts have been made by those skilled in the art to reduce the hydrogen-generating voltage at the cathode as far as possible, as is commonly known.

The cathode is made generally of soft steel which is coated with nickel or a precious metal. In this conventional manner, however, the base electrode material or iron dissolves liably out into the aqueous caustic alkali solution especially at the hydrogen-generating potential balance, and in the form of $HFeO_2^-$. Therefore, it will naturally be encountered that, with increased effort to lower the overpotential in the above meaning, the iron dissolution will rather liably occur. Thus, it is a long desire among those skilled in the art to provide a cathodic electrode structure which satisfies the favorable overpotential requirement as well as an extended durable life of the cathodic electrode without sacrificing the electrolytic performance.

It has already been proposed to improve the cathodic electrode by replacing the iron with stainless steel or nickel as the base material. However, in these cases, disadvantageous dissolution will equally occur in the form of $HFeO_2^-$ and $HNiO_2^-$, respectively, much difficulty being thereby encountered in keeping the precious metal surface layer in its stabilized and favorable operating conditions.

It is, therefore, an object of the present ivention to provide an efficient and durable cathodic electrode without the foregoing conventional drawbacks.

SUMMARY OF THE INVENTION

For this purpose, we employ copper as the base material of the electrode which is then subjected at first to a mechanical surface working for roughening and activation, and then to a coating step with rhodium or rhodium alloy. According to the invention, the hydrogen superpotential can be lowered by 0.2–0.4 volt.

The term "copper" used herein means not only copper alone, but also it includes a copper alloy with nickel, iron, zinc, tin, gold, silver, platinum, rhodium, titanium or the like alloy constituent or a combination thereof.

DETAILED DESCRIPTION OF THE INVENTION

Figure 1:
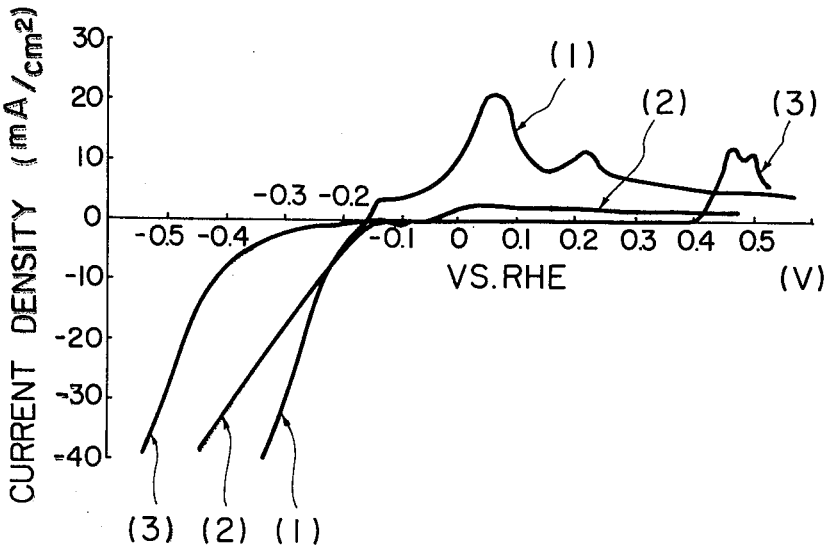
FIG. 1 represents three different voltamgraphic charts of iron-, nickel- and cooper electrodes, respectively.

In FIG. 1, voltamgrams of iron, nickel and copper measured in a 3N-NaOH solution at 80° C. are shown.

These are shown in their respective order at (1), (2) and (3). As clearly seen from these charts, the iron shows its dissolving behavior in the form of $HFeO_2^-$ by −150 to −200 milivolts inferior than the equilibrium potential for hydrogen generation. In the similar way, the nickel shows the similar behavior in the form of $HNiO_2^-$ by −10 to −50 milivolts inferior than the equilibrium potential. On the contrary, the copper shows a highly stabilized performance in this respect. Therefore, it will be well seen that the copper is a highly efficient and suitable base material of the cathode adapted for use in the electrolysis of caustic alkali in aqueous solution thereof and accompanying the generation of gaseous hydrogen.

In the present invention, the copper electrode is further coated with a rhodium or rhodium alloy layer which represents face-centered cubic lattices similar to those of the copper, thereby providing a better affinity of the coated layer to the base. As is well known, the electric conductance of copper is four to six times superior with respect to iron or nickel. Thus, it is highly efficient as the electrode base metal. The invention has been completed by utilizing these superior and advantageous features.

Before the coating, the copper electrode is subjected to a mechanical grinding step. The step is effected so as not only to remove the oxide coating, but also to invite a roughening effect for increase of the surface area as well as a formation of a large number of activated points on the base material surface. This step may preferably be effected by the blasting technique so that the collision of the blasted solid particles upon the raw copper electrode surface, causes the said formation of activated points. In place of the chemical grinding, the presently adopted mechanical grinding, preferably the blasting of solid particles, provides such an advantage that the base copper electrode surface can be improved so as to be effectively used for the desired purpose regardless of specific past history of the copper material, by changing the grain size, shape and kind of the blasting particles, as well as the blasting air pressure.

The grinding solid particles may be those of C; $Al_2O_3$; $Fe_2O_3$; $Fe_2O_4$; $Fe_3O_4$; $Al_2O_3$; $SiO_2$; $CaCO_3$; $MgCO_3$; $B_6C$; $B_2C_2$; SiC; $W_2C$; WC; CaO·MgO; $Cr_2O_3$; MgO. Briefly to say, substantially every kind of natural or artificial solid particles known per se for mechanical grinding may be utilized as well. The particle size may extend from 0.1 to 1,000 microns, more preferably 1–200 microns.

The roughened and activated electrode surface is coated with rhodium or rhodium alloy layer to provide a completed electrode. The rhodium is highly superior among platinum metals so that it is especially durable in an alkalline atmosphere and represents a lower hydrogen superpotential, thus being highly suitable for the purpose of the present invention. As the method for rhodium or rhodium alloy coating, one of the conventional processes may be relied upon. As an example, the thermal decomposition of rhodium salt and thermal baking of the rhodium may be utilized. The electroplating or non-electronic coating process may also be utilized. Any other suitable coating process may be adopted.

Being coated, the electrode may be preferably subjected to a heat treatment in a reduced or inactive gaseous atmosphere kept at 200° C. or higher temperature, for increase of the durable life of the electrode. However, those which have been subjected to no heat treatment can be used for the general purpose of the invention.

As was disclosed hereinbefore, according to this invention, a raw copper electrode is subjected to mechanical grinding for roughening and activation, and then coated with a rhodium or rhodium alloy layer to complete the electrode. Thus, high antichemical performance of copper, favorable crystal features thereof and better conductance of the copper can be advantageously and fully utilized in the present invention. By subjecting the raw copper electrode to a mechanical working, preferably in the form of solid particle-blasting, the roughening and activating effect of the surface of the raw copper electrode can be effectively utilized for providing an intimate and durable later coating of rhodium or rhodium alloy which acts as the active metal of the finished cathode when using. In this way, a specific, efficient and durable cathodic electrode showing a lowest possible hydrogen superpotential appearing in the electrolytic service of the cathode in the caustic alkali solution bath.

The invention will be described in a more specific and detailed manner by way of an electrode-manufacturing example and a service example of the cathodic electrode according to this invention.

MANUFACTURING EXAMPLE

Nine pieces of copper bar conductor, each being of 3 mm - diameter, were taken out. These bars were grouped into three groups and blasted with three kinds of "Alundum" ($Al_2O_3$) #30; #80 and #400, manufactured and sold by Norton Co., by compressed air of 4–5 kg/cm$^2$. These sand-blasted raw electrodes were grouped to B, C and D, respectively.

Each one element of these three sand-blasted raw electrode groups was taken out, washed with water and then subjected to an electrolytic plating step in an rhodium-plating bath at 40° C. with a current density of 10 A/dm$^2$ for providing each with a rhodium-coating layer. These samples were named with (B), (C) and (D), respectively.

With these sample electrodes, hydrogen superpotential was measured in a 3N-NaOH solution at 80° C., using a silver chloride electrode as a comparative one. The hydrogen-generating equilibrium potential was measured with use of a platinum electrode and under same electrolytic conditions as above.

On the other hand, non-treated copper bars were grouped into a sample group A. One of the bare copper bar was plated with a rhodium layer and nominated with sample (A). Further, a non-blasted and non-coated steel bar electrode, of 3 mm-diameter. was nominated with sample E.

By use of all these electrode samples, hydrogen superpotential values were measured. The results are illustrated in FIG. 2.

Figure 2:
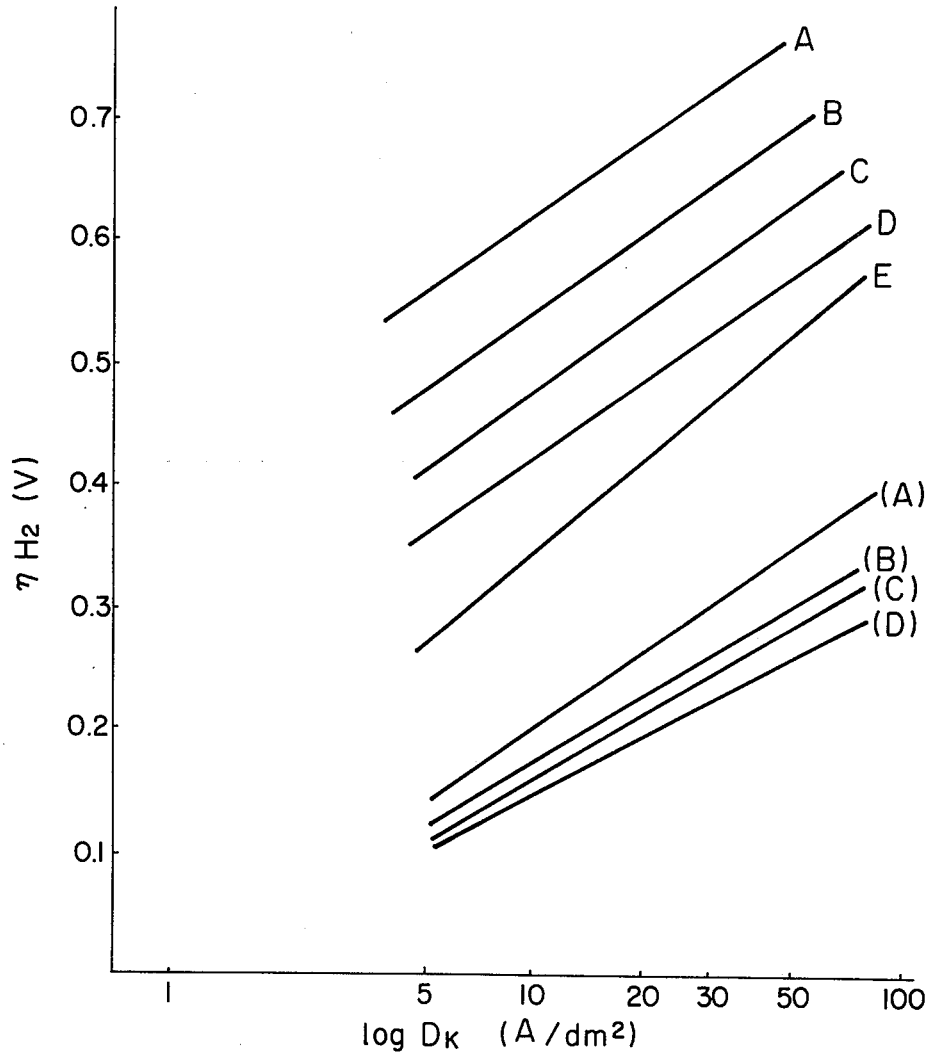
FIG. 2 represents a number of comparative charts of several different electrodes of iron, copper and rhodium-coated copper, in terms of the hydrogen superpotential plotted against the current density.

From FIG. 2, it will be clear that the cathodic electrode according to this invention represents a lower superpotential by 0.2 volt or still larger, than that of the conventional soft steel electrode. Further, it may be seen that, although the hydrogen superpotential of the bare copper electrode is rather high, the potential can be substantially lowered with rhodium. In this case, it will be further seen that, by roughening the copper electrode surface, the effect has been further improved to a substantial degree.

SERVICE EXAMPLE

Eight copper bar electrodes similar to the foregoing sample group (C), each being 9 cm long, were taken out and arranged equidistantly in parallel. In this way, a 9 cm×4 cm-arrangement of eight bar electrodes was provided to form a cathode unit. The anodic electrode was of DAS, and the cation exchange membrane being prepared from "NAFION—390", manufactured and sold by Du Pont. The electrolysis of NaCl was performed with a two-chamber type electrolytic vessel. The brine was a 26%—NaCl aqua-solution. The bath temperature was 80° C. The NaOH—concentration at the cathode was 20%.

For comparative purpose, soft steel electrodes of the same dimensions as above were used. The results are shown in the following Table 1.

TABLE 1

| Sample/Current Density | 10 A/dm$^2$ | 20 A/dm$^2$ | 30 A/dm$^2$ |
|---|---|---|---|
| Inventive Cathode | 2.6 V | 2.85 V | 3.10 V |
| Comparative Cathode | 2.8 V | 3.10 V | 3.40 V |

As can be clearly understood from the foregoing, the inventive cathode provides a voltage gain of 0.2 volt or more in comparison with conventional soft steel cathodes and even with the practical service electrolysis.

With increased current density, the gain will become more predominant. According to practical service tests, the inventive cathodic electrodes can be used continuously for at least three months without trouble. In this case, the service voltage fluctuation was very small and the durability of the inventive cathodes were also found to be superior.

Additionally, the abscissa in FIG. 1 represents voltages relative to hydrogen electrode. Potential scanning velocity was 0.05 $VS^{-1}$. "$\eta H_2$" in FIG. 2 represents hydrogen superpotential of copper, while "Dk" represents current density.

The embodiments of the invention in which an exclusive property or privilege is claimed are as follows:

1. A cathode electrode for use in the electrolysis of alkali halide, said cathode electrode comprising a mass of one of copper and copper alloy subjected to mechanical grinding by blasting with solid particles of 0.1–1,000 microns in their particle sizes so as to achieve a mechanically ground surface, the latter being coated with one of rhodium and rhodium alloy coated layer.

* * * * *